US005389028A

United States Patent [19]

Cabrera et al.

[11] Patent Number: 5,389,028

[45] Date of Patent: Feb. 14, 1995

[54] CHRISTMAS STOCKING, PUPPET AND STORY MEDIA COMBINATION

[76] Inventors: Catherine Cabrera, 12727 Parkyns St., Los Angeles, Calif. 90049; Pepper de Callier; Priscilla de Callier, both of 99 Riverside Dr. #13, Burbank, Calif. 91506

[21] Appl. No.: 983,664

[22] Filed: Dec. 1, 1992

[51] Int. Cl.[6] ..... A63H 3/00; A63H 3/14

[52] U.S. Cl. ..... 446/73; 446/76; 446/327

[58] Field of Search ..... 446/69, 72, 73, 75, 446/76, 327–329, 321; D11/126; 428/3, 7

[56] References Cited

U.S. PATENT DOCUMENTS

| | | | |
|---|---|---|---|
| 3,226,849 | 1/1966 | Rosen | 446/329 |
| 4,372,077 | 2/1983 | Balbuena | 446/73 |
| 4,508,515 | 4/1985 | Skolnick | 446/327 |
| 4,795,398 | 1/1989 | Wexler | 446/310 |
| 5,090,938 | 2/1992 | Reynolds | 446/73 |

FOREIGN PATENT DOCUMENTS

| | | | |
|---|---|---|---|
| 2215226 | 9/1989 | United Kingdom | 446/321 |

*Primary Examiner*—Robert A. Hafer
*Assistant Examiner*—Jeffrey D. Carlson
*Attorney, Agent, or Firm*—Pandiscio & Pandiscio

[57] ABSTRACT

An integrally formed Christmas stocking and puppet is provided in combination with a story media sized to be contained within the open-ended cavity of the Christmas stocking. The Christmas stocking includes a sidewall having a first side and a second side, the first side carrying decorative means indicative of the Christmas season and the second side carrying decorative means defining a puppet character. The stocking is reversible such that in a first configuration the second side of the sidewall faces the interior of the stocking cavity and in a second configuration the first side of the sidewall faces the interior of the stocking cavity. The story media is attached to the second side of the sidewall in the vicinity of the closed end of the stocking cavity. A hanger is attached to the first side of the sidewall adjacent the open end of the stocking cavity. The reversal of the configuration of the stocking from its first configuration to its second configuration is facilitated by the withdrawal of the story media from the stocking cavity.

18 Claims, 6 Drawing Sheets

CHRISTMAS STOCKING, PUPPET AND STORY MEDIA COMBINATION

FIELD OF THE INVENTION

This invention relies generally to toys. More particularly, this invention relates to a Christmas stocking, puppet and story media combination.

BACKGROUND OF THE INVENTION

The tradition of hanging stockings from the mantelpiece of a fireplace (or at another selected location in the house) on Christmas Eve is one of the best known and widely practiced traditions of the Christmas season in the United States. According to custom, "Santa Claus" will appear during the night and fill the empty stocking with candy, fruit, small toys and the like as a reward for good behavior during the preceding year.

Over the years, the so-called Christmas stockings have grown in size to the point where they are typically several times the size of a normal sock, and they are often festively decorated on their outer surface. This decoration typically takes the form of winter or holiday pictorial designs, pictures of toys, or any one of many other festive designs. For example, synthetic fur is often attached to the stocking about its open top end, while bright colors, patterns and/or pictorial images cover the outer surface of the remainder of the stocking. In many cases, the name of the stocking's owner (i.e., the individual to whom the gifts in the stocking are directed) is also placed on the outside of the stocking. Christmas stockings also typically include a hanger element (frequently in the form of a loop of material) located adjacent the rear edge of its open top end, so as to facilitate hanging the stocking in an upright manner from the mantelpiece, etc.

It is also well known among children and adults that the exterior surface of a stocking-like article can be decorated to form a simple hand puppet. In one simple form, this is achieved simply by appropriately decorating the exterior of a conventional sock. In such an arrangement, the exterior surface of the sock is typically decorated so that the heel of the sock represents the top of the head of the puppet character which is being created, the closed toe end of the sock forms the mouth of the character, and the eyes and nose of the character are placed as appropriate between the toe and heel of the sock. Additionally, the portion of the stocking extending from its heel to its open end may be decorated so as to represent the neck of the character being created.

It is also well known among children and adults that puppets can be utilized in storytelling situations. In such circumstances, the puppet typically depicts one of the characters in the story and is used as a prop by the storyteller to heighten the listener's enjoyment.

OBJECTS AND SUMMARY OF THE INVENTION

One object of the present invention is to provide, in combination, a Christmas stocking, a puppet and a story media such that in one configuration the stocking functions as a Christmas stocking adapted to hold the story media and various small presents from Santa Claus, and in a second configuration functions as a hand puppet, wherein the hand puppet may or may not depict one of the characters from the associated story media.

Another object of the present invention is to provide a Christmas stocking, puppet and story media combination wherein the story media is contained within and is attached to the inner surface of the stocking in the vicinity of its closed end when the combination is in its Christmas stocking configuration, such that during the course of removing gifts from the stocking the story media will be grasped by the user and the stocking thereafter pulled inside out as the story media is removed from the stocking, thereby revealing the combination's puppet configuration.

Still another object of the present invention is to provide story media which is able to be received within the interior of the Christmas stocking and which is conveniently usable in play activities utilizing the puppet.

These and other objects of the present invention are provided in a preferred embodiment of the invention by an enlarged stocking-like article and a story media which is adapted to be contained within the stocking-like article. More particularly, the stocking-like article includes an open end, a closed end, a first side and a second side. The first side of the stocking-like article carries an appropriate Christmas stocking design, and preferably includes a loop or other hanger element adjacent the open end. The second side of the stocking-like article carries decorative elements which form a puppet character. The story media is attached to the second side of the stocking-like article, in the vicinity of the closed end of the stocking-like article. The story media may be in the form of a book, an audio tape, a video tape, a compact disc, a floppy disk or some other conveniently usable media for use with the puppet or otherwise. The story media may also include a container sized to receive the book, audio tape, video tape, compact disc, floppy disk or the like.

In use, the stocking-like article is initially placed in a first configuration, wherein the first side of the article (i.e., the Christmas stocking side of the article) faces outward. In this configuration, the stocking-like article takes on the appearance of a Christmas stocking, and the loop or other hanger element extends outwardly from the stocking-like article so as to be available to hang the article from a convenient support structure (e.g. a mantelpiece). Also, in this configuration, the story media (which is attached to the second side of the stocking-like article, in the vicinity of its closed end) can be conveniently placed within the stocking cavity, along with any other small gifts from Santa Claus which are to be received by the stocking's owner.

Thereafter, on Christmas morning, the gifts held in the Christmas stocking may be removed in the usual manner, i.e., by the owner reaching into the stocking-like article through its open end and withdrawing the gifts. When the owner thereafter grasps the story media and attempts to withdraw it through the open end of the stocking-like article, the attachment of the story media to the second side of the stocking-like article will cause the stocking-like article to be pulled inside out, thereby revealing the puppet decoration on the second side of the stocking-like article.

Finally, the story media may be disconnected from the stocking-like article and the puppet thereafter played with in a conventional manner, i.e., by inserting a hand into the open end of the stocking-like article and then manipulating the closed end of the article so as to animate the puppet. It is to be appreciated that the puppet may be played with either in conjunction with the story media (to which it is preferably related, in the sense of subject matter) or separately.

BRIEF DESCRIPTION OF THE DRAWINGS

These and other objects and features of the present invention will become more fully apparent to those skilled in the art in view of the following detailed description of a preferred embodiment of the invention, which is to be considered together with the accompanying schematic drawings wherein.

DETAILED DESCRIPTION OF THE PREFERRED EMBODIMENT

Figure 1:
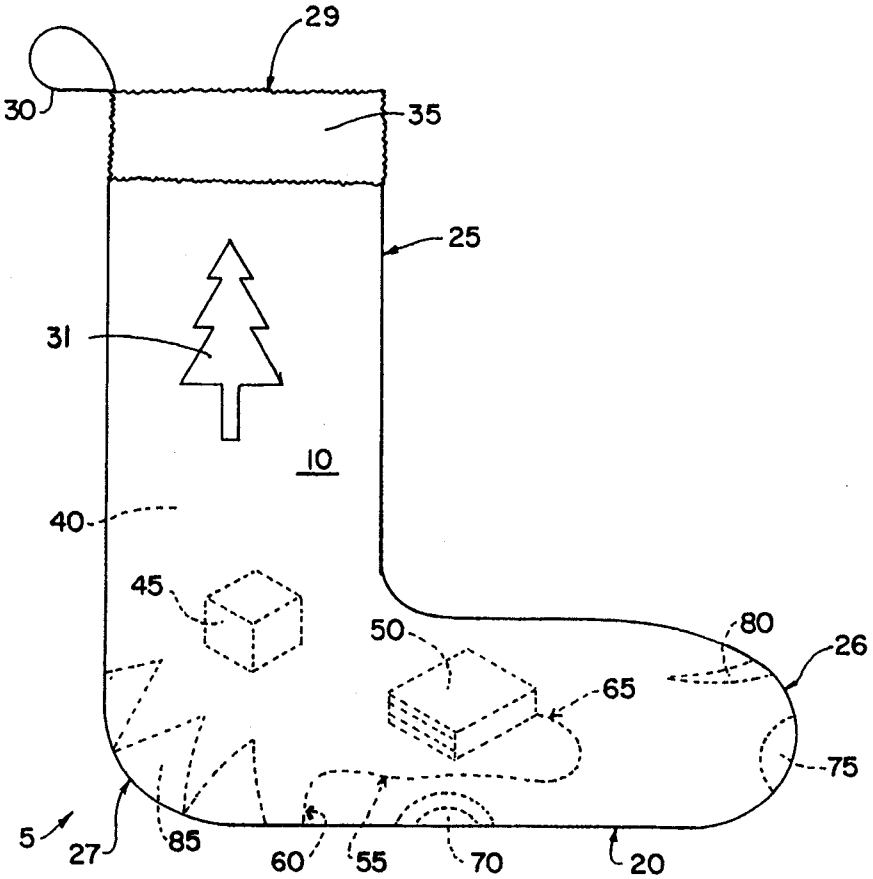
FIG. 1 is a side view in elevation of a stocking-like article formed in accordance with the present invention, wherein the article is in its first configuration wherein its first side faces outwardly, and further wherein the stocking-like article contains the story media.

Referring now to the drawings, and particularly to FIG. 1, there is shown a stocking-like article 5 formed in accordance with the present invention. The stocking-like article 5 includes a first side 10, a second side 15 (see FIG. 5) a closed end 20 and an open end 25. The closed end 20 includes both a toe portion 26 and a heel portion 27. The open end 25 includes an opening 29. A loop 30 is attached to and extends outwardly from first side 10 adjacent to opening 29, as shown. The article's first side 10 preferably carries one or more brightly colored Christmas designs 31, as well as a decorative fur portion 35 which covers first side 10 adjacent opening 29. Although not shown in the drawings, it is to be appreciated that fur portion 35 might also extend around to the portion of second side 15 located adjacent to opening 29, i.e., so that fur portion 35 covers both sides of the stocking-like article adjacent to opening 29.

Thus it will be seen that stocking-like article 5 can function as a Christmas stocking when it is in the configuration shown in FIG. 1. Accordingly, article 5 defines an interior region or cavity 40 which is suitable for receiving and holding one or more presents 45 of the sort typically provided by Santa Claus on Christmas Eve. The loop 30 provides a convenient means by which the stocking-like article 5 may be hung adjacent to a fireplace, or at some other convenient location, on Christmas Eve.

In accordance with the present invention, a story media 50 is attached to the second side 15 of the article 5 in the vicinity of its closed end 20. Preferably story media 50 is attached to the article's second side 15 somewhere between the article's toe portion 26 and its heel portion 27, e.g. in the manner shown in FIG. 1, so as to facilitate turning the stocking-like article inside out when media 50 is withdrawn from the stocking-like article. Of course, the exact point of attachment may vary according to fabric characteristics, stocking geometries, etc. For example, in some situations (e.g. where the stocking's foot section is relatively short) media 50 may be attached to toe portion 26, at the innermost part of closed end 20; in other situations (e.g. where the stocking's foot section is relatively long and hence more prone to bunching during inversion) media 50 may be attached to the stocking as far back as heel portion 27. It is anticipated that in most circumstances attachment will be desired in the region somewhere in between toe portion 26 and heel portion 27 (e.g. such as in the manner shown in FIG. 1).

Story media 50 may be a small book, an audio tape, a video tape, a compact disc, a floppy disk or some other story-containing element of the sort adapted to be contained within article's interior region or cavity 40. If desired, story media 50 may be contained within an appropriately sized container (not shown) of the sort well known in the art. Story media 50 is preferably attached to article 5 by a flexible, elongated string-like or ribbon-like means such as a piece of strong thread or twine, an elongated piece of fabric or a lightweight chain, as representatively indicated at 55. Elongated means 55 includes a first end 60 (which is attached to the second side 15 of article 5 in the vicinity of its closed end 20) and a second end 65 (which is attached to story media 50). Alternatively, story media 50 might be attached directly to the second side 15 of article 5 (e.g. by gluing) and elongated means 55 omitted entirely, although this construction is generally not preferred.

Also in accordance with the present invention, various puppet features (such as eyes 70, nose 75, mouth 80, bony scales 85, etc.) are attached to the article's second side 15, whereby the article's second side will provide the appearance of a puppet, as will hereinafter be discussed in further detail.

In use, article 5 is configured in the manner shown in FIG. 1, i.e., with first side 10 facing outwardly and with story media 50 contained within interior region 40, and then the article is hung from a mantelpiece or the like using loop 30. Gifts 45 are thereafter placed inside the stocking.

Figure 2:
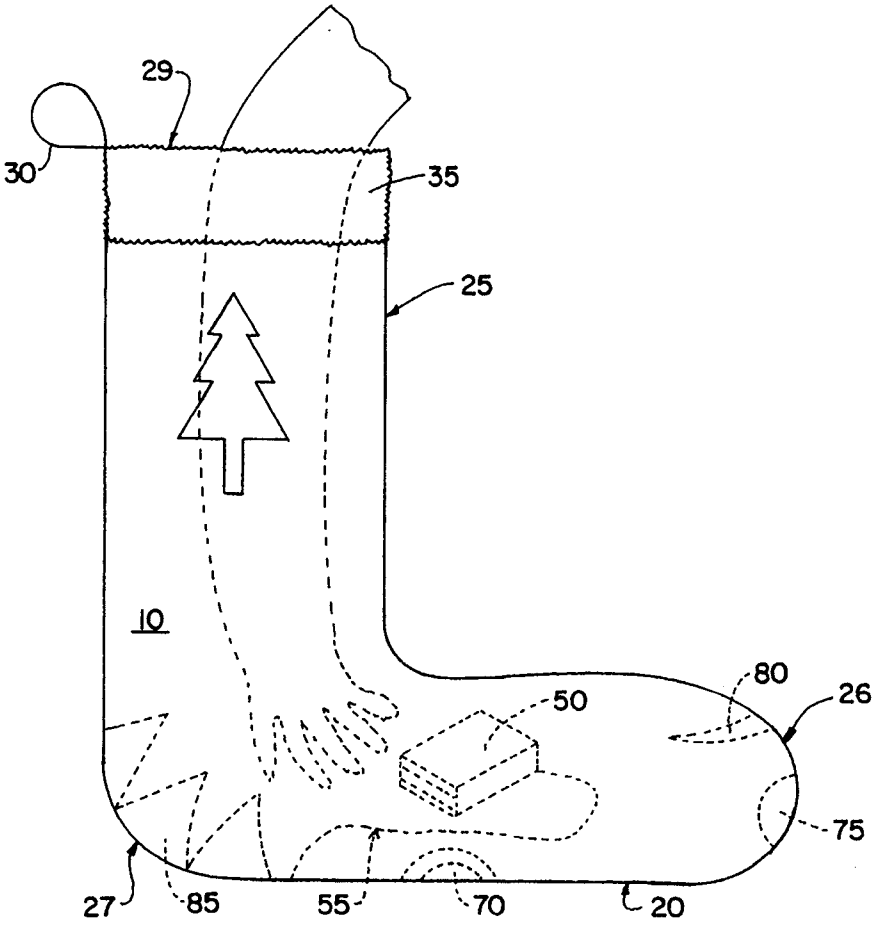
FIG. 2 is a side view in elevation of the stocking-like article of FIG. 1, wherein the owner's hand is shown extending into the open end of the stocking-like article.

FIG. 2 illustrates use of the article on Christmas morning. More specifically, article 5 is removed from its hanging position and then the owner of the stocking starts to remove the small gifts 45 contained within the stocking. This is done by inserting his or her hand into the interior 40 of article 5 via the article's opening 29.

Figure 4:
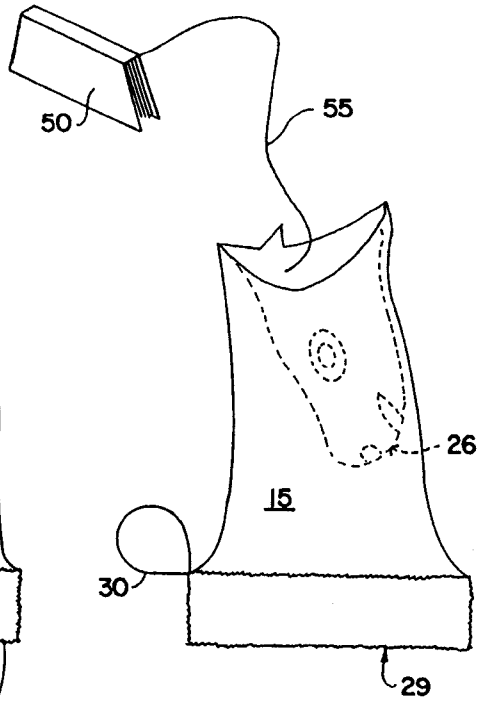
FIG. 4 is a side view in elevation similar to that of FIG. 3, except that the stocking-like article has been pulled further inside-out so as to expose more of the article's second side.
Figure 3:
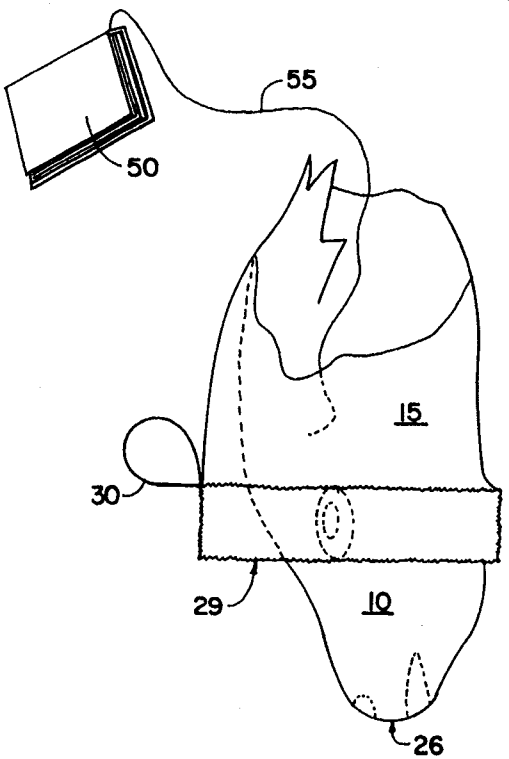
FIG. 3 is a side view in elevation showing the configuration of the stocking-like article of FIGS. 1 and 2 when the story media has been pulled out of the article's open end.

After the majority of the gifts 45 contained within the article's interior 40 have been removed, the owner of the article 5 will reach story media 50. At that point, the owner will grasp story media 50 and attempt to remove it from the interior 40 of article 5 in the same manner that the other gifts 45 are removed from interior 40. By virtue of the attachment of story media 50 to the second side 15 of article 5, however, this pulling on story media 50 will cause the article's closed end 20 to be pulled first toward (see FIG. 3) and then through (see FIG. 4) the opening 29 of the article 5. In effect, this pulling on story media 50 will cause article 5 to be turned at least partially inside out, so that the puppet-decorated second side 15 will become significantly exposed to the stocking's owner.

At this point, the puppet-like nature of the second surface 15 will become apparent to the owner of the article. Further pulling on the story media 50, and/or pulling directly on various portions of article 5 itself, will cause article 5 to be turned completely inside out, so that it assumes the configuration shown in FIG. 5, whereby the article's puppet surface 15 is completely exposed. Story media 50 may then be disconnected from article 5 by cutting elongated means 55, preferably at both its first end 60 adjacent article 5 and at its second end 65 adjacent story media 50, so that both article 5 and story media 50 are free from elongated means 55. The puppet of article 5 may then be used in the usual manner, either separately or in conjunction with the story media 50 if desired.

In this respect it is to be appreciated that in at least the preferred form of the invention, the subject matters of the puppet of article 5 and story media 50 are intended to be closely related to one another, i.e., the puppet is intended to depict one of the characters of story media 50. In such a situation it is anticipated that the puppet will frequently, though not always, be used in conjunction with story media 50. Of course, it is also to be appreciated that the subject matters of the puppet and story media may be totally unrelated to one another, if desired.

Figure 5:
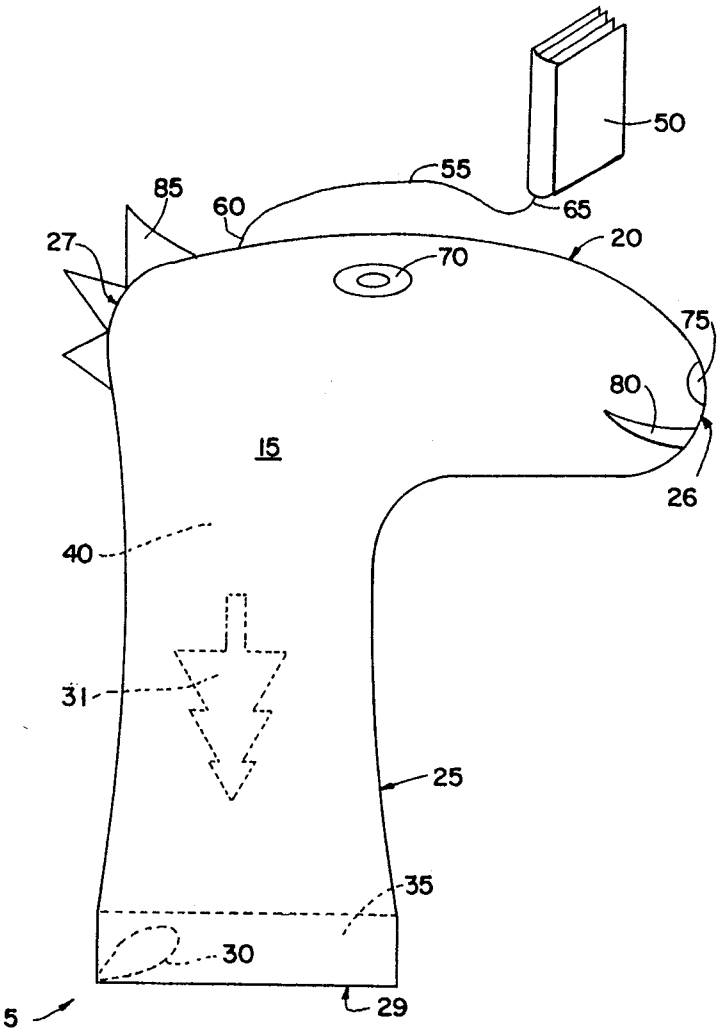
FIG. 5 is a side view in elevation showing the stocking-like article totally reversed relative to the configuration depicted in FIG. 1, so that it is in its second configuration wherein its second side faces outwardly.

Referring now to FIG. 5 of the drawings, it will also be seen that the puppet configuration of the preferred embodiment of the invention contemplates that the heel portion 27 of the stocking-like article 5 will constitute the top of the head of the character being depicted; the portion between the heel portion 27 and the article's opening 29 will constitute the neck of the character; and the portion between heel portion 27 and toe portion 26 will constitute the face of the character. To this end, eyes 70, nose 75, mouth 80, bony scales 85, etc. are appropriately positioned on second side 15. If desired, the mouth of the puppet may be arranged so that when the user's hand is fully inserted into the interior 40 of article 5, a portion of toe portion 26 may extend inwardly between the user's thumb on one side and his fingers on the other side, so that the character's mouth can be opened and closed as desired.

Furthermore, it is also to be appreciated that while the puppet of article 5 has been configured in the drawings to show one possible character (i.e., a dragon-like character), this has been done solely for purposes of illustration and not by way of limitation. In fact, the specific nature of the puppet character depicted on article 5, as well as the specific nature of the Christmas designs 31 placed on first surface 10, are purely matters of choice and form no part of the present invention in its broadest aspects. In a more narrow form of the invention, however, it will be appreciated that the specific nature of the puppet depicted on article 5 may be carefully coordinated with the nature of story media 50, in the sense that the puppet may depict a character from that story.

Having thus described both the structure and the method of use for a preferred form of the invention, it should be noted that it is also contemplated that various modifications, alterations, changes and variations will occur to those skilled in that art.

Thus, for example, in one alternative embodiment, representatively shown in FIGS. 6-11, the stocking-like article 105 may include a first stocking-like element 106 and a correspondingly-sized, second stocking-like element 107. The first stocking-like element 106 includes a first side 110 decorated in a manner similar to the side 10 of the article 5 described above (i.e., a Christmas stocking), a second side 115, a closed end 120, and an open end 125. Closed end 120 includes both a toe portion 126 and a heel portion 127. Open end 125 includes an opening 129. A loop 130 extends outwardly from the first side 110, substantially adjacent to the opening 29.

Similarly, the second stocking-like element 107 includes a first side 131 decorated in a manner corresponding to the second side 15 of the article 5 described above (i.e., a puppet character), a second side 132, a closed end 133 and an open end 134. Closed end 133 includes both a toe portion 136 and a heel portion 137. Open end 134 includes an opening 139.

The edges of the open ends 125 and 134 around openings 129 and 139 are attached together, e.g. by sewing or the like, so as to enable the two stocking-like elements 106 and 107 to assume an overlapping configuration (see FIG. 6) or a mirror-image like configuration (see FIG. 10), as desired. Story media 150, which is similar to the story media 50 described above with respect to article 5, is attached to the first side 131 of the second stocking-like element 107 in the vicinity of its closed end 133. Preferably story media 150 is attached to the first side 131 of the second stocking-like element 107 somewhere between the element's toe portion 136 and its heel portion 137, e.g. in the manner shown in FIG. 6, so as to facilitate turning the second stocking-like element 107 inside out when media 150 is withdrawn from the stocking-like element. Preferably story media 150 is attached to the first side 131 of the second stocking-like element 107 via the elongated element 155. Element 155 is similar to the element 55 previously described, and comprises a first end 160 (which is attached to the second stocking-like element 107) and a second end 165 (which is attached to story media 150).

Figure 6:
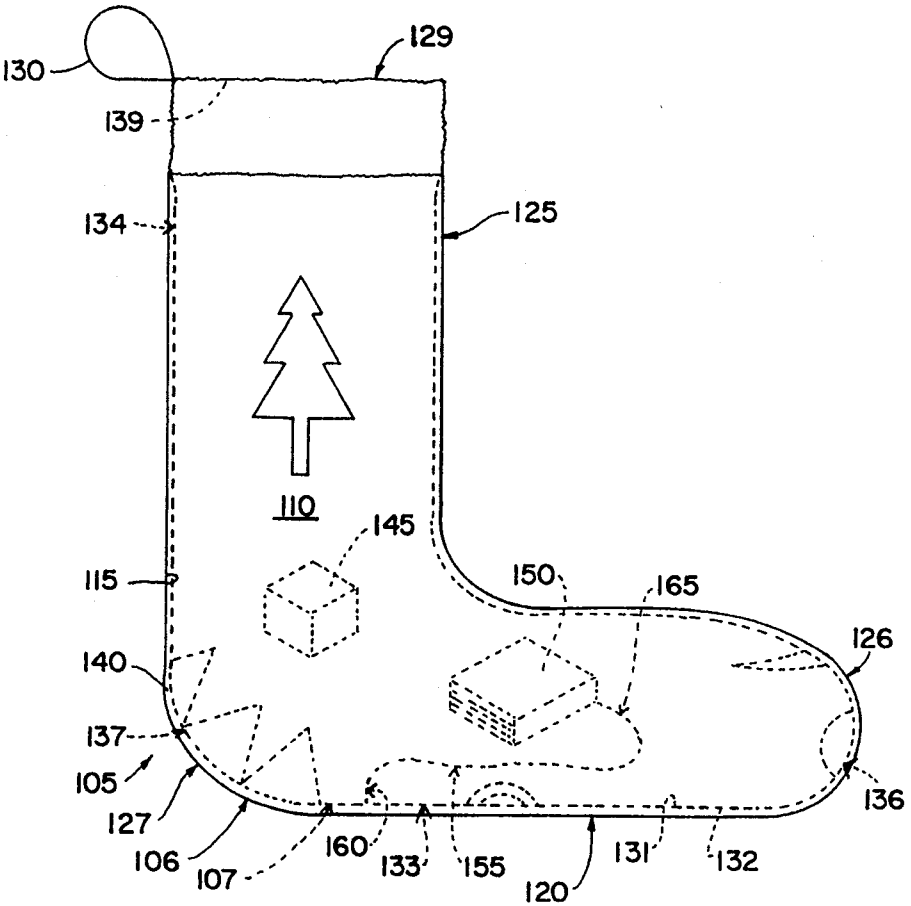
FIG. 6 is a side view in elevation of an alternative form of stocking-like article made in accordance with the present invention, wherein the stocking-like article includes a first stocking-like element and a second stocking-like element joined together at their respective open ends, with the stocking-like article being in a first configuration wherein the second stocking-like element resides inside out within the first stocking-like element.

In a first configuration of this alternative embodiment of the invention, which configuration is depicted in FIG. 6, the article 105 is adapted to function as a Christmas stocking. In this first configuration, the second stocking-like element 107 is inserted into the opening 129 of the first stocking-like element 106 so as to reside within the interior 140 of the first stocking-like element 106 so that side 132 faces side 115. In this manner, the article 105 assumes a stocking-like configuration which is analogous to the configuration of article 5 depicted in FIG. 1. In this alternative, however, the sidewall of the stocking-like article 105 includes two layers of material and the gift-receiving region is defined by side 131 of second stocking-like element 107.

Figure 7:
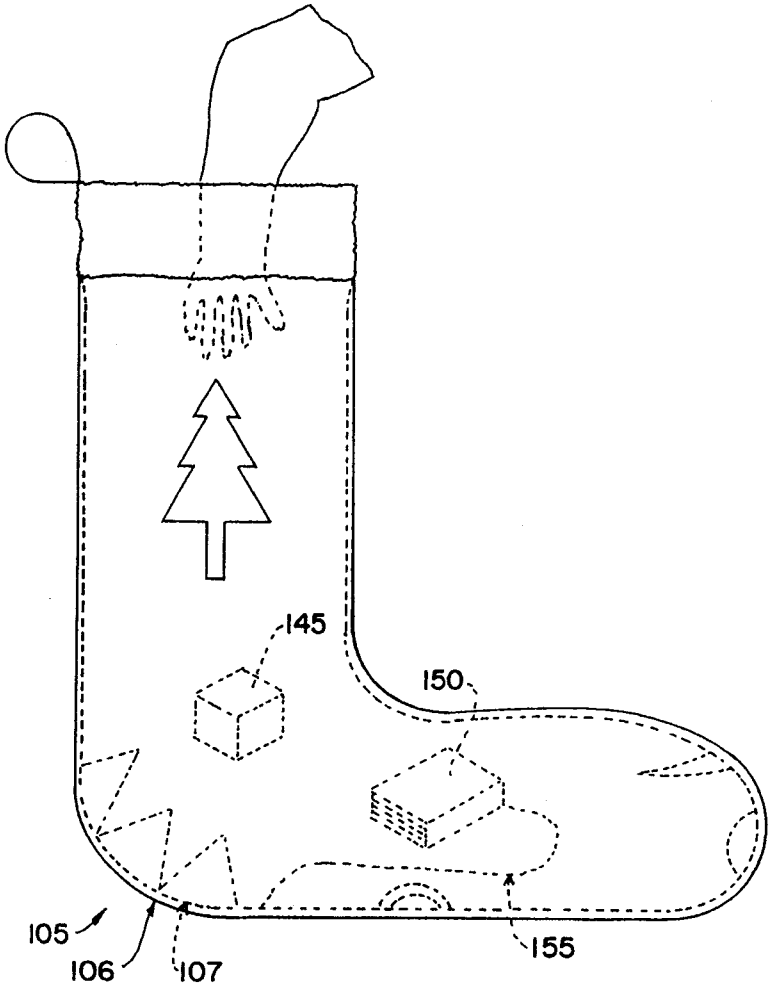
FIG. 7 is a side elevational view of the stocking-shaped article of FIG. 6, wherein the owner's hand is shown extending into the open end of the stocking-like article.

Similarly, as illustratively shown in FIG. 7, the article 105 may be filled with small gifts 145 during the night before Christmas, and those gifts may be subsequently removed by the owner of the article 105 on Christmas morning simply by inserting his or her hand into the stocking, grasping the gifts either singly or in groups, and removing the same through the top of the stocking.

Figure 9:
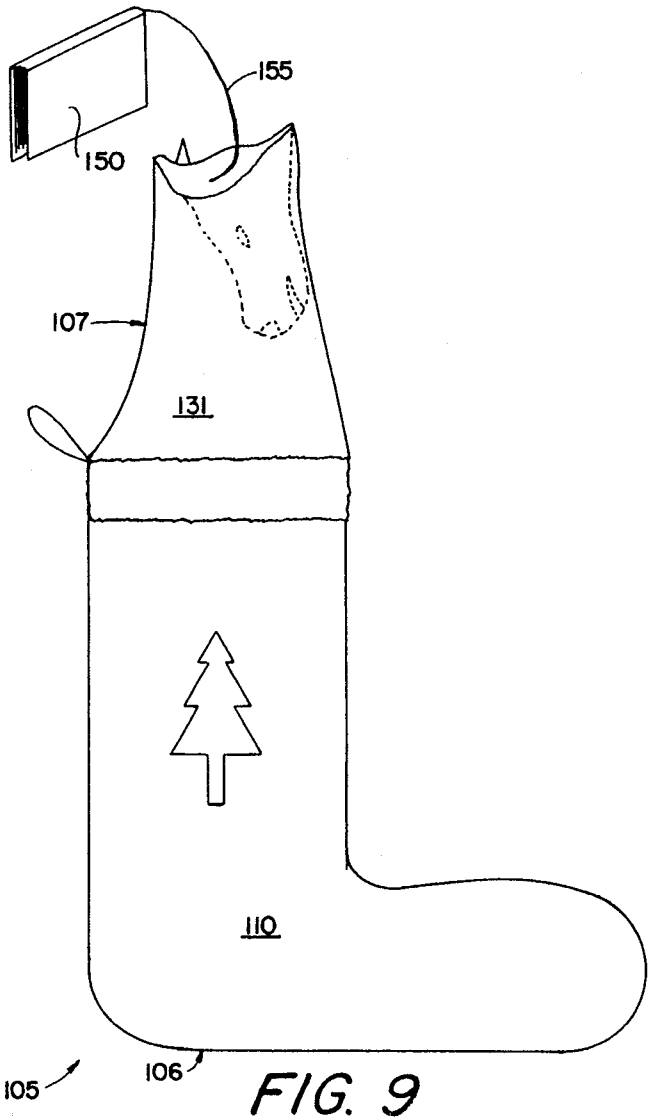
FIG. 9 is a side view in elevation similar to that of FIG. 8, except that the second stocking-like element has been pulled further out of the open end of the first stocking-like element.
Figure 8:
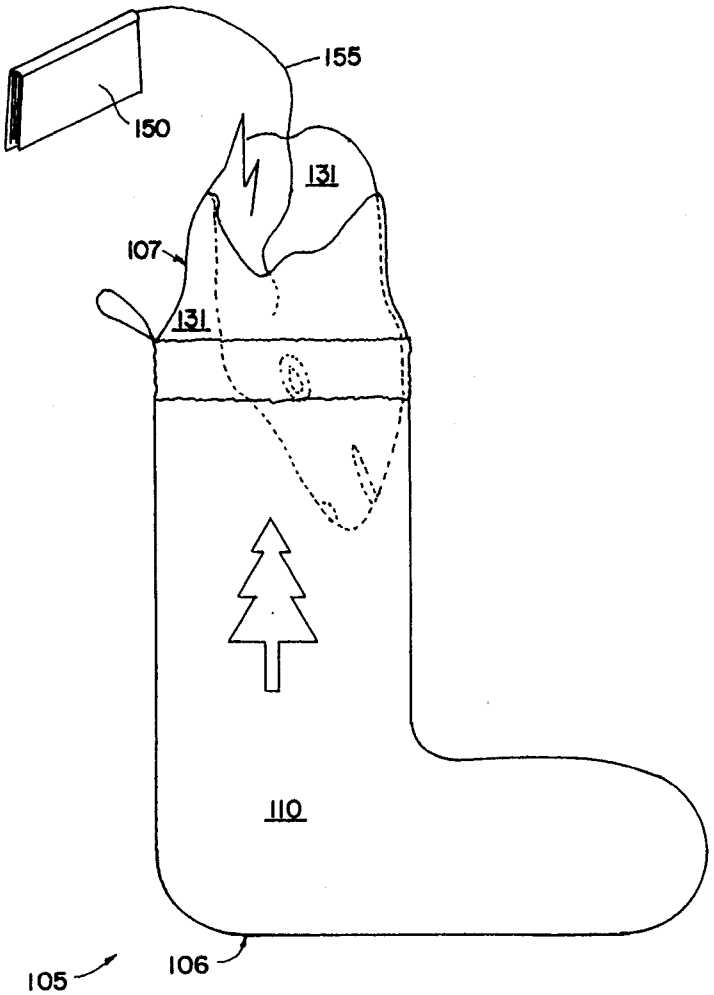
FIG. 8 is a side view in elevation of the stocking-like article of FIGS. 6 and 7 when the story media has been pulled out of the article's open end.

As shown in FIGS. 8 and 9, the owner will eventually grasp the story media 150 and attempt to remove it from article 105 in the same manner as the other gifts. Due to the attachment of the story media 150 to the first side 131 of the second stocking-like element 107, however, this pulling on the story media 150 will cause the second stocking-like element 107 to be drawn through the opening 129 of the first stocking-like element 106, turning it inside out as it does so. At this point, the puppet-like nature of surface 131 will become apparent to the owner of article 105. Further pulling on the story media 150, and/or pulling directly on various portions of the second stocking-like element 107 itself, will cause element 107 to be turned completely inside out, so that the two stocking-like elements 106 and 107 are deployed in a sort of mirror-image configuration such as that shown in FIG. 10.

Figure 10:
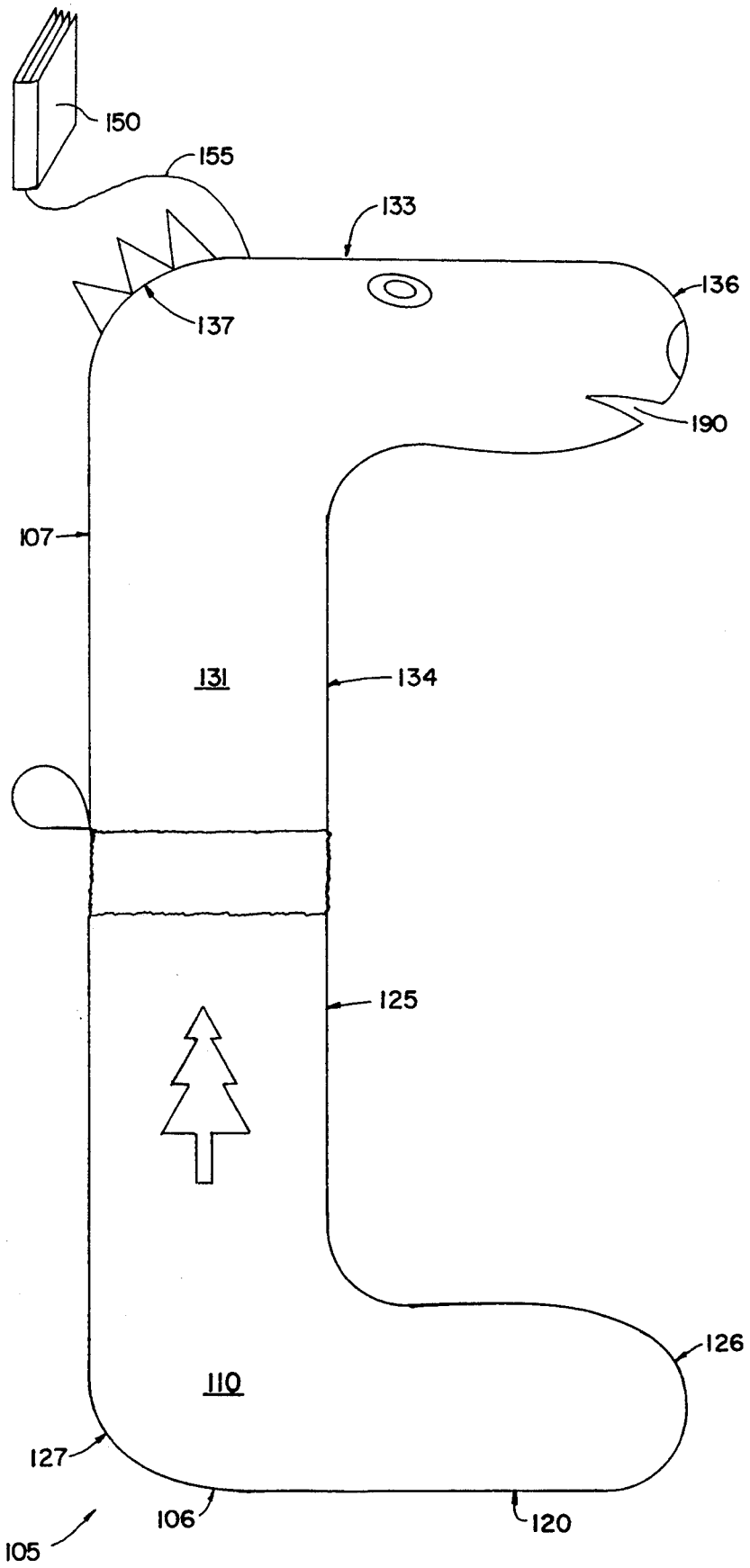
FIG. 10 is a side view in elevation similar to that of FIGS. 8 and 9, except that the second stocking-like element has been fully removed from the interior of the first stocking-like element.
Figure 11:
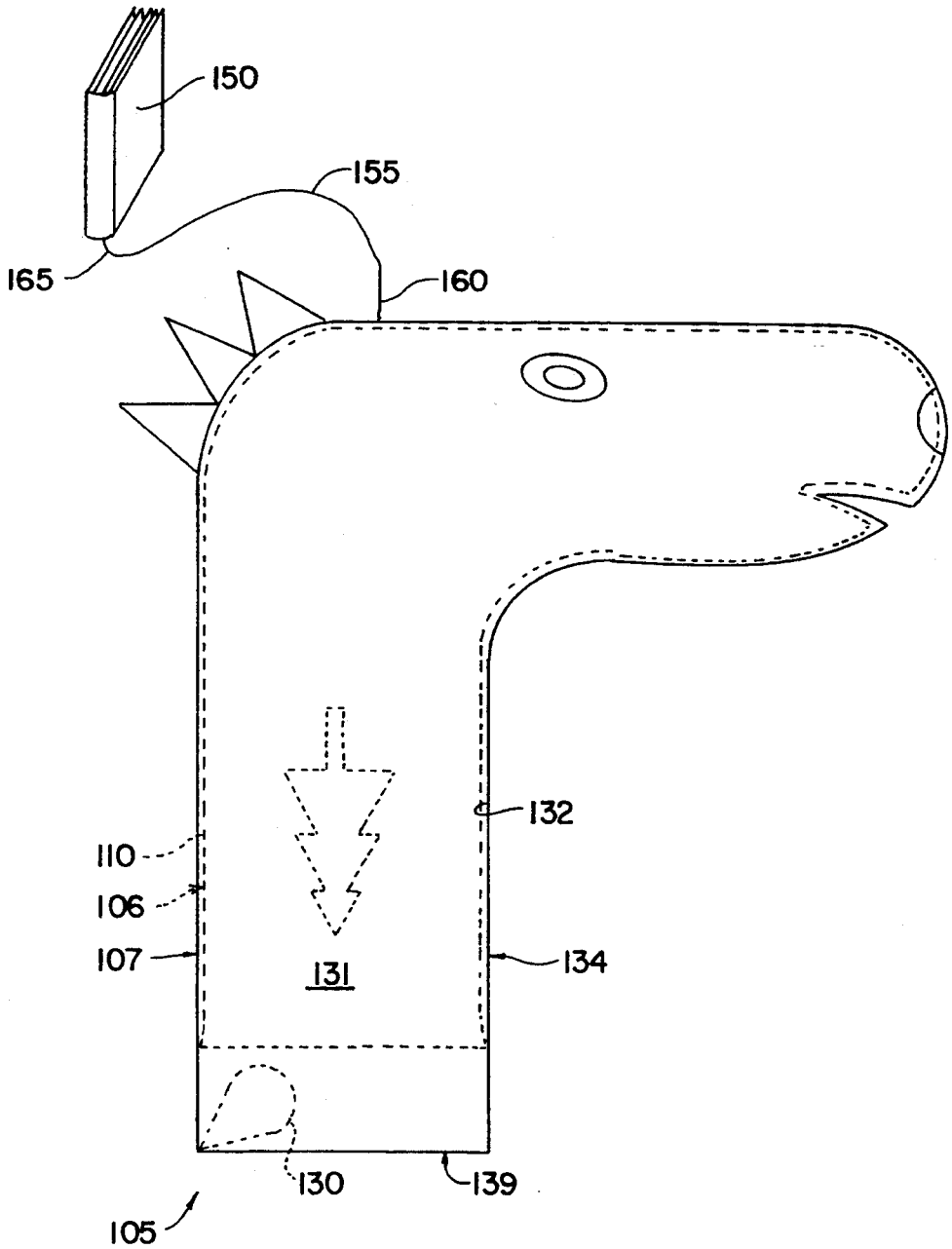
FIG. 11 is a side elevational view in elevation showing the stocking-like article in a second configuration wherein the first stocking-like element resides inside out within the second stocking-like element.

Upon achieving the configuration shown in FIG. 10, the owner of article 105 will easily be able to manipulate the first stocking-like element 106 into the open end 134 of the second stocking-like element 107, such that the first side 110 of the first stocking-like element 106 faces the second side 132 of the second stocking-like element 107, i.e., into a configuration wherein the relative orientations of the first and second stocking-like elements 106 and 107 are reversed from that shown in FIG. 6. See FIG. 11. Story media 150 may then be separated from article 105, e.g. by cutting at first end 160 and second 165, and then story media 150 and article 105 used in a manner analogous to that previously described with respect to story media 50 and article 5.

The alternative embodiment of the invention shown in FIGS. 6–11 may provide several advantages over the preferred embodiment shown in FIGS. 1–5. Specifically, the fact that the puppet of the second embodiment is formed from a separate stocking-like element (i.e., element 107) allows that stocking-like element 107 to be modified as desired so as to enhance the presentation of the puppet without interfering with the presentation of the Christmas stocking. Thus, for example, stocking-like element 107 could be modified so as to provide a permanent slot 190 (FIG. 10) formed in the toe portion 136 of the second stocking-like element 107 so as to form an improved puppet mouth; at the same time, the first stocking-like element 106 could retain its normal stocking geometry. In this way article 105 can form an improved puppet when in its puppet configuration (FIG. 11), yet still present a traditional Christmas stocking appearance when in its Christmas stocking configuration. Such a construction is not possible with the embodiment of FIGS. 1–5, since in that case a single stocking-like element carries both the Christmas stocking decoration and the puppet decoration and the provision of a mouth slot in the stocking-like element would adversely effect the appearance of the Christmas stocking. In addition to the foregoing, depending upon the nature and complexity of the puppet character desired to be created, it may also be less costly to form the Christmas stocking and the puppet separately from one another, out of two stocking-like elements 106 and 107, and then to simply sew their open ends together as a final assembly operation (e.g. in the manner of FIGS. 6–11), rather than to decorate both sides of a single layer stocking-like article (e.g. in the manner of FIGS. 1–5).

These and other changes of their type are considered to be within the scope of the present invention.

What we claim is:

1. A toy comprising in combination:

a Christmas stocking, a puppet and a story media;

said Christmas stocking and said puppet being integrally formed and comprising an enlarged stocking-like article including a sidewall having a first side and a second side, a closed first end and an open second end such that said stocking-like article defines an open-ended cavity sized to receive a human hand therein, said stocking-like article being reversible such that in a first configuration said second side of said sidewall faces the interior of said cavity and in a second configuration said first side of said sidewall faces the interior of said cavity;

said first side of said sidewall including decorative means indicative of the Christmas season, and said second side of said sidewall including decorative means thereon simulating a puppet character; and said story media comprising an element sized to fit within said open-ended cavity, said story media element being connected to said second side of said sidewall in the vicinity of said closed end such that said story media element can reside within said open-ended cavity when said stocking-like article is in its said first configuration, and such that pulling said story media element through said open second end will cause said stocking-like article to turn substantially inside out and to substantially assume its said second configuration.

2. A toy according to claim 1 wherein said story media element is connected to said second side of said sidewall by elongated attachment means.

3. A toy according to claim 2 wherein said toy further comprises hanging means attached to said first side of said sidewall adjacent said open end of said stocking-like article.

4. A toy according to claim 2 wherein said story media comprises a book.

5. A toy according to claim 2 wherein said story media comprises an audio tape.

6. A toy according to claim 2 wherein said story media comprises a video tape.

7. A toy according to claim 2 wherein said story media comprises a compact disc.

8. A toy according to claim 2 wherein said story media comprises a floppy disk.

9. A toy according to claim 2 wherein said elongated connecting means is selected from the group consisting of strong thread, twine, a length of cloth material, stretch resistant polymer materials and lightweight metallic chain.

10. A toy according to claim 1 wherein the subject matter of said story media is closely related to the subject matter of said puppet character.

11. A toy according to claim 1 wherein said Christmas stocking and puppet comprise a pair of correspondingly-sized, stocking-like elements each having a decorated first side, a second side, a closed end and an open end, said open ends being attached together such that one of said stocking-like elements may be inserted within the other of said stocking-like elements so that the inserted stocking-like element has its first side disposed adjacent to the second side of the receiving stocking-like element, and such that the relative orientations of said stocking-like elements may be reversed.

12. A method for using a Christmas stocking, puppet and story media combination of the type comprising:

an integrally formed Christmas stocking and puppet comprising an enlarged stocking-like article including a sidewall having a first side and a second side, a closed first end and an open second end such that said stocking-like article defines an open-ended cavity sized to receive a human hand therein, said stocking-like article being reversible such that in a first configuration said second side of said sidewall faces the interior of said cavity and in a second configuration said first side of said sidewall faces the interior of said cavity;

said first side of said sidewall including decorative means indicative of the Christmas season, and said second side of said sidewall including decorative means thereon simulating a puppet character; and said story media comprising an element sized to fit within said open-ended cavity, said element being connected to said second side of said sidewall in the vicinity of said closed end of said stocking-like article by elongated attachment means;

said method comprising the steps of:

(a) manipulating said Christmas stocking, puppet and story media combination such that said second side of said sidewall faces the interior of said open-ended cavity and said story media resides within said open-ended cavity;

(b) reaching into said open-ended cavity, grasping said story media element and withdrawing said story media element through said open end while holding said open end of said stocking-like article such that said elongated connecting means pulls said second side of said sidewall to and through said open end of said stocking-like article, and thereafter manipulating said stocking-like article to the extent required to place it fully into its said second configuration; and (c) inserting a hand into said open-ended cavity such that said hand can manipulate said closed end of said stocking-like article in the manner of a puppet.

13. An improved Christmas stocking of the sort comprising an enlarged stocking-like article including a sidewall having a first side and a second side, a closed first end and an open second end such that said stocking-like article defines an open-ended cavity sized to receive presents, wherein said first side of said sidewall includes decorative means indicative of the Christmas season and said second side faces the interior of said cavity, wherein said second side of said sidewall includes decorative means thereon simulating a puppet character, such that when said Christmas stocking is turned completely inside out so that all of said first side of said sidewall faces the interior of said cavity, said stocking-like article may be used as a puppet and further wherein said stocking comprises story media attached to said second side of said sidewall in the vicinity of said closed end, said story media being sized to fit within said open-ended cavity, such that when said stocking-like article is disposed so that said second side faces the interior of said cavity, said story media may reside inside said cavity, and such that thereafter pulling said story media through said open second end will cause said stocking-like article to turn substantially inside out so that said first side of said sidewall will substantially face the interior of said cavity.

14. An improved Christmas stocking according to claim 13 wherein said story media is connected to said stocking-like article by elongated attachment means.

15. An improved stocking according to claim 13 wherein the subject matter of said story media is closely related to the subject matter of said puppet character.

16. In a Christmas stocking of the sort comprising an enlarged stocking-like article including a sidewall having a first side and a second side, a closed first end and an open second end such that said stocking-like article defines an open-ended cavity sized to receive presents, wherein said first side of said sidewall includes decorative means indicative of the Christmas season and said second side faces the interior of said cavity;

the improvement wherein:

said second side of said sidewall includes decorative means thereon simulating a puppet character, such that when said Christmas stocking is turned inside out so that said first side of said sidewall faces the interior of said cavity, said stocking-like article may be used as a puppet, said stocking further comprising story media attached to said second side of said sidewall in the vicinity of said closed end, said story media being sized to fit within said open-ended cavity, such that when said stocking-like article is disposed so that said second side faces the interior of said cavity, said story media may reside inside said cavity, and such that thereafter pulling said story media through said open second end will cause said stocking-like article to turn substantially inside out so that said first side of said sidewall will substantially face the interior of said cavity.

17. An improved Christmas stocking according to claim 16 wherein said story media is connected to said stocking-like article by elongated attachment means.

18. An improved stocking according to claim 16 wherein the subject matter of said story media is closely related to the subject matter of said puppet character.

* * * * *

UNITED STATES PATENT AND TRADEMARK OFFICE

CERTIFICATE OF CORRECTION

PATENT NO. : 5,389,028

DATED : 02/14/95

INVENTOR(S) : Catherine Cabrera et al.

It is certified that error appears in the above-indentified patent and that said Letters Patent is hereby corrected as shown below:

On the title page, item [76] , under "Inventors:", with respect to the address for the co-inventors Pepper de Callier and Priscilla de Callier, "99 Riverside Dr. #13" should be -- 990 Riverside Dr. #13 --.

Signed and Sealed this

Seventeenth Day of June, 1997

*Attest:*

Bruce Lehman

BRUCE LEHMAN

*Attesting Officer*

*Commissioner of Patents and Trademarks*